US011573530B2

(12) United States Patent
Stranczl et al.

(10) Patent No.: US 11,573,530 B2
(45) Date of Patent: Feb. 7, 2023

(54) ADJUSTMENT MEMBER FOR WATCHES

(71) Applicant: Montres Breguet S.A., L'Abbaye (CH)

(72) Inventors: Marc Stranczl, Nyon (CH); Polychronis Nakis Karapatis, Premier (CH)

(73) Assignee: Montres Breguet S.A., L'Abbaye (CH)

( * ) Notice: Subject to any disclaimer, the term of this patent is extended or adjusted under 35 U.S.C. 154(b) by 590 days.

(21) Appl. No.: 16/596,924

(22) Filed: Oct. 9, 2019

(65) Prior Publication Data

US 2020/0150592 A1 May 14, 2020

(30) Foreign Application Priority Data

Nov. 9, 2018 (EP) ..... 18205441

(51) Int. Cl.

| | |
|---|---|
| ***G04B 15/12*** | (2006.01) |
| ***G04C 5/00*** | (2006.01) |
| ***G04B 15/08*** | (2006.01) |
| ***G04B 17/28*** | (2006.01) |

(52) U.S. Cl.

CPC ..... *G04B 15/12* (2013.01); *G04C 5/005* (2013.01); *G04B 15/08* (2013.01); *G04B 17/285* (2013.01)

(58) Field of Classification Search

CPC ..... G04B 17/285; G04B 15/08; G04B 15/12; G04C 5/005

USPC ..... 368/127

See application file for complete search history.

(56) References Cited

U.S. PATENT DOCUMENTS

| | | | | |
|---|---|---|---|---|
| 8,210,739 | B2 * | 7/2012 | Greubel | G04B 17/285 368/127 |
| 2006/0187760 | A1 * | 8/2006 | Kasapi | G04B 17/285 368/127 |
| 2007/0201317 | A1 | 8/2007 | Houlon | |
| 2009/0268565 | A1 * | 10/2009 | Salathe | G04B 17/285 368/131 |

(Continued)

FOREIGN PATENT DOCUMENTS

| | | | |
|---|---|---|---|
| CN | 101091141 | A | 12/2007 |
| CN | 101268425 | A | 9/2008 |

(Continued)

OTHER PUBLICATIONS

Notice of the Reason for Refusal dated Sep. 23, 2020 in Japanese Patent Application No. 2019-190904 (with English language translation), 5 pages.

(Continued)

*Primary Examiner* — Edwin A. Leon
*Assistant Examiner* — Kevin Andrew Johnston
(74) *Attorney, Agent, or Firm* — Oblon, McClelland, Maier & Neustadt, L.L.P.

(57) ABSTRACT

An adjustment member for a watch including a fixed structure extending substantially perpendicularly to an axial direction, the adjustment member including a regulating member with a balance arranged to pivot about a balance axis, this balance is pivoted by magnetic pivots in a carriage, arranged to pivot about a carriage axis, and comprised in a device for annulling variations in rate in the vertical positions, formed by a tourbillon or a carrousel, comprised in the adjustment member, and the carriage carrying magnets defining the balance axis which is perpendicular or oblique to the carriage axis.

7 Claims, 7 Drawing Sheets

(56) References Cited

U.S. PATENT DOCUMENTS

| | | | | |
|---|---|---|---|---|
| 2010/0046329 | A1 | 2/2010 | Greubel et al. | |
| 2012/0112589 | A1* | 5/2012 | Marechal | G04B 31/004 310/90.5 |
| 2013/0215723 | A1 | 8/2013 | Forsey et al. | |
| 2014/0098647 | A1* | 4/2014 | Kasapi | G04B 17/00 368/127 |
| 2015/0234361 | A1 | 8/2015 | Marechal et al. | |
| 2015/0277381 | A1* | 10/2015 | Forsey | G04B 17/285 368/127 |
| 2019/0146420 | A1* | 5/2019 | Piguet | G04D 7/1264 73/1.46 |

FOREIGN PATENT DOCUMENTS

| | | | | |
|---|---|---|---|---|
| CN | 101681148 | A | 3/2010 | |
| CN | 103620510 | A | 3/2014 | |
| CN | 104737081 | A | 6/2015 | |
| CN | 207571477 | U | 7/2018 | |
| CN | 102540856 | A | 7/2021 | |
| EP | 1574916 | A2 * | 9/2005 | G04B 17/285 |
| EP | 2 282 240 | A2 | 2/2011 | |
| EP | 2 593 839 | A1 | 5/2013 | |
| EP | 3106933 | A1 * | 12/2016 | F16C 17/08 |
| FR | 1 115 966 | | 5/1956 | |
| JP | 2008-518221 | A | 5/2008 | |
| JP | 2010-523957 | A | 7/2010 | |
| WO | WO 03/017009 | A2 | 2/2003 | |
| WO | WO 2012/062524 | A1 | 5/2012 | |
| WO | WO 2018/198068 | A1 | 11/2018 | |

OTHER PUBLICATIONS

Combined Chinese Office Action and Search Report dated Dec. 14, 2020, in Chinese Patent Application No. 201911086742.X (with English translation), 13 pages.

European Search Report dated Apr. 9, 2019 in European Application 18205441.1 filed on Nov. 9, 2018 (with English Translation of Categories of Cited Documents).

* cited by examiner

Fig. 1
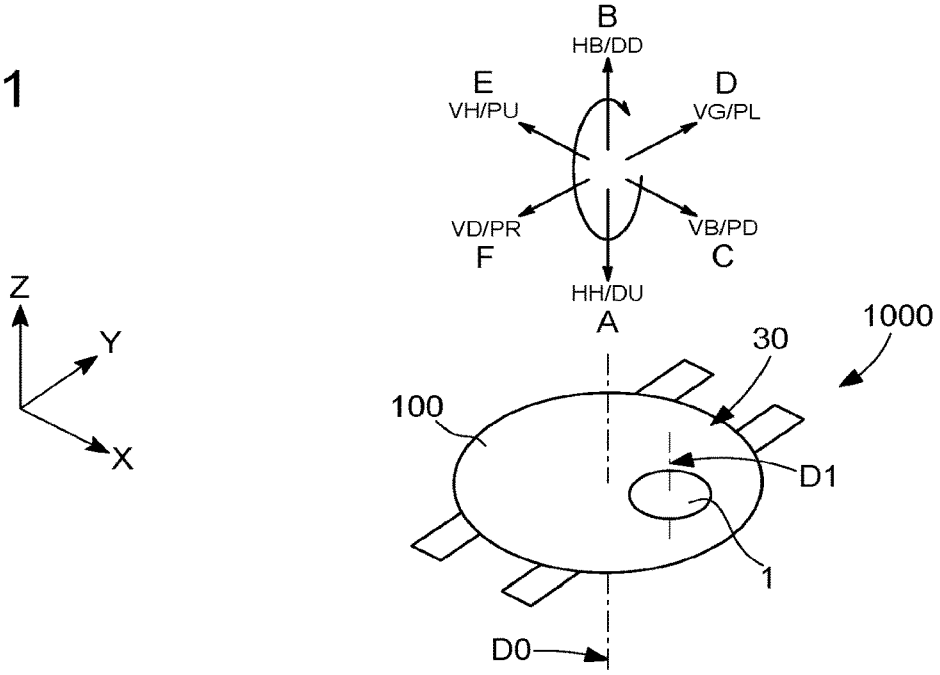
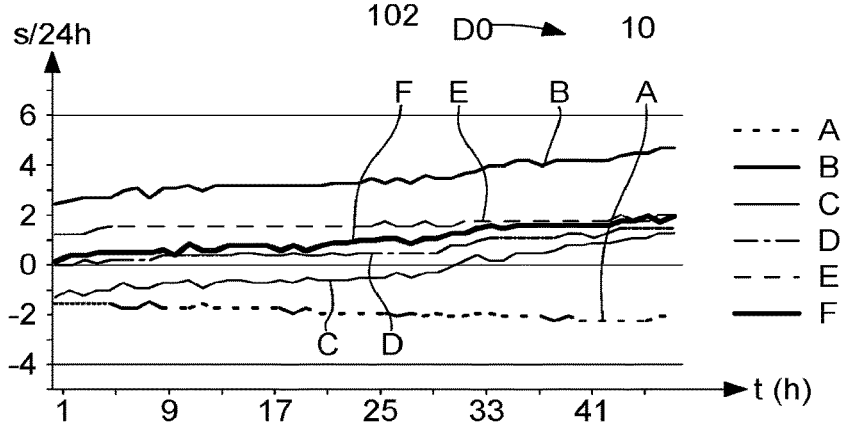
Fig. 2
Fig. 3
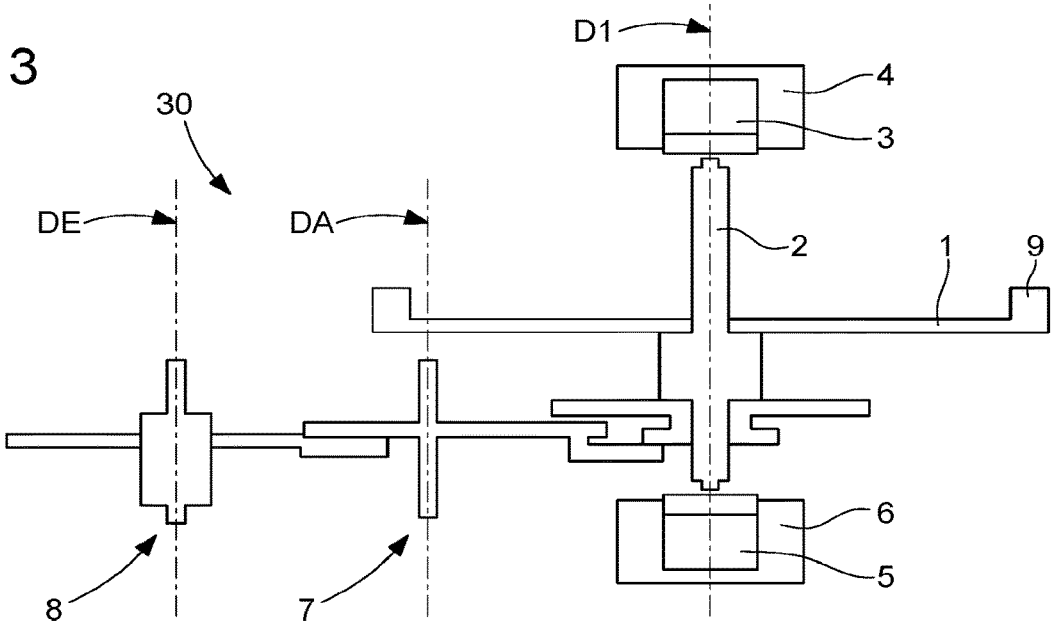

ADJUSTMENT MEMBER FOR WATCHES

CROSS-REFERENCE TO RELATED APPLICATION

This application claims priority to European Patent Application No. 18205441.1 filed on Nov. 9, 2018, the entire disclosure of which is hereby incorporated herein by reference.

FIELD OF THE INVENTION

The invention concerns an adjustment member for a watch comprising a fixed structure extending substantially perpendicularly to an axial direction, said adjustment member comprising a regulating member with a balance arranged to pivot about a balance axis.

The invention also concerns a watch including such an adjustment member.

The invention also concerns a method for optimising the chronometric properties of a mechanical watch comprising a fixed structure extending substantially perpendicularly to an axial direction, and comprising an adjustment member comprising a regulating member with a balance arranged to pivot about a balance axis.

The invention concerns the field of adjustment members for watches.

BACKGROUND OF THE INVENTION

The search for better chronometric performance is a constant preoccupation of major watch companies. Essentially, this means guaranteeing a constant rate, regardless of the geometrical position of a watch in space and with respect to the field of gravity.

The invention of the tourbillon by Abraham-Louis Breguet in 1901 and improvements thereto, and the invention of carrousels, particularly developed by Bonniksen at the beginning of the 20th century, constituted tremendous progress.

These mechanisms have been continuously improved, like inclined tourbillons, which still uses conventional pivots for the balance staff.

Reducing the last seconds of variation in rate per day remains a very difficult objective to achieve.

French Patent Application FR1115966A in the name of JUNGHANS discloses a regulating system with a rotating balance for timepiece movements, with static magnetic fields which at least partially annul the weight of the oscillating assembly. In particular, for an oscillating assembly with a non-vertical axis, the magnetic fields annulling the weight of the oscillating assembly engage at two points spaced apart from each other, preferably at the ends of the pivot bearing the balance. The balance pivot can carry permanent magnets in the form of symmetrically magnetized rings on the periphery, cooperating with permanent magnets integral with fixed supports, the poles of the two magnets of each pair being mounted in opposition.

European Patent Application No. EP2282240A1 in the name of LVMH discloses a regulating unit which includes a balance connected to a movable permanent magnet which oscillates along a circular path about an axis of rotation of the balance. Fixed permanent magnets generate a magnetic field to return the balance to a stable position of equilibrium. An escapement maintains the motion of the balance about the position of equilibrium.

Patent Application No. WO03/017009A2 in the name of COMPLITIME discloses a tourbillon intended to be fitted to a timepiece movement comprising a frame and a going train, and which includes a carriage holding an escapement rotatably mounted about a carriage axis forming an angle $\alpha$ different from 0° or 90° with respect to the axis of rotation of the wheel sets of the going train; this escapement-holder carriage comprises a carriage gear coaxial to the carriage axis and meshing with a wheel set mounted on the frame. A balance/balance spring and an escapement comprising a wheel set with an escape pinion pivot in the escapement-holder carriage. The escape pinion is meshed with a toothing mounted on the frame and lying in a plane perpendicular to the axis of the escapement-holder carriage. In particular, angle $\alpha$ is comprised between 20° and 70° and preferably substantially equal to 30°. More particularly, the balance and the escape wheel sets pivot about axes parallel to the carriage axis.

SUMMARY OF THE INVENTION

It is an object of the invention to further improve the chronometric properties of adjustment members, in particular but not exclusively as regards tourbillons or carrousels, by adopting specific pivot axis geometries for the various wheel sets, together with the use of magnetic pivot means, at least for the inertia weight of the resonator, particularly a balance.

Thus, the invention concerns an adjustment member for watches.

The invention also concerns a watch including such an adjustment member.

The invention further concerns a method for optimising the chronometric properties of a mechanical watch comprising a fixed structure extending substantially perpendicularly to an axial direction, and comprising an adjustment member including a regulating member with a balance arranged to pivot about a balance axis.

BRIEF DESCRIPTION OF THE DRAWINGS

Other features and advantages of the invention will appear upon reading the following detailed description with reference to the annexed drawings, in which:

FIG. 1 represents a schematic view of a watch which includes a fixed structure, which extends substantially in a plane and perpendicularly to an axial direction; a member comprises a balance pivoting about a balance axis parallel to the axial direction.

FIG. 2 is a rate diagram, which shows the typical chronometric properties of a resonator with magnetic balance pivots, as a function of time on the abscissa, with the variation in rate on the ordinate, in seconds per day; the standard positions VB, VH, VD, VG, HH, and HB in french, i.e. in english vertical pendant down PD, vertical pendant up PU, vertical pendant right PR, vertical pendant left PL, horizontal dial up DU, horizontal dial down DD, are indicated in FIG. 1, with reference to an XYZ trihedron whose Z axis corresponds to the field of gravity.

FIG. 3 shows a schematic, sectional view of the regulating member of the mechanism of FIGS. 1 to 2.

DETAILED DESCRIPTION OF PREFERRED EMBODIMENTS

Figure 4:
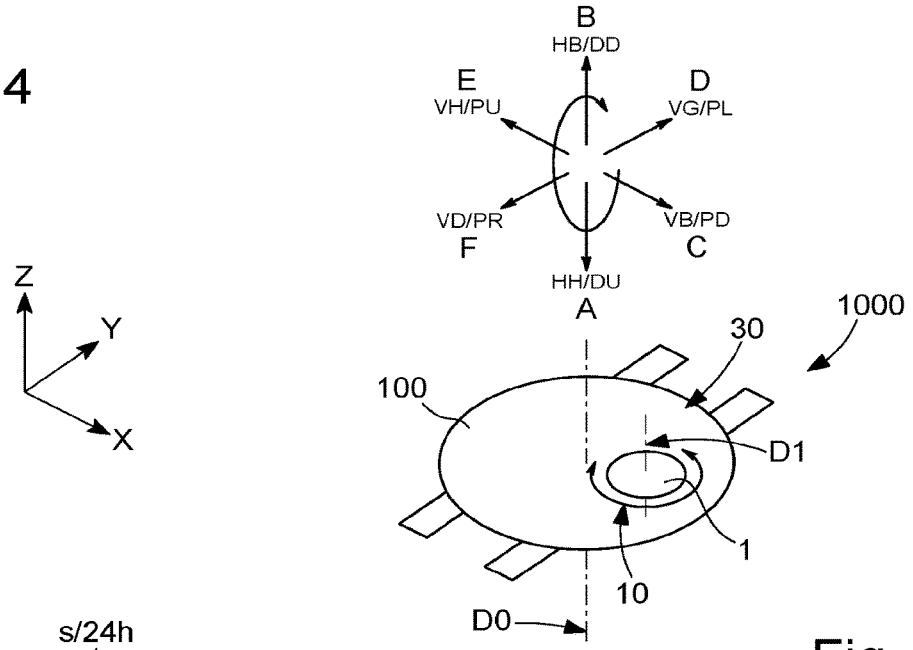
FIG. 4 represents a schematic view, similar to FIG. 1, of a mechanism comprising a conventional tourbillon, wherein the carriage axis is, like the balance axis, parallel to the axial direction.

FIG. 1 shows, in a very schematic manner, a watch 1000, which includes a fixed structure 100, typically comprising a main plate and bridges.

This fixed structure 100 extends in a conventional manner substantially in a plane intended to be tangent to the user's wrist for a wristwatch, or tangent to the body or clothing of the user in the case of a pocket watch. This fixed structure 100 extends substantially perpendicularly to an axial direction D0. In most watches, this axial direction D0 is that of the axes of the display members such as hands or discs contained in a watch movement.

FIG. 1 shows only part of the adjustment member, in this case an inertia weight, which is a balance 1 here, which is returned towards a rest position by elastic return means (not represented), such as a balance spring or flexible strips. This balance 1 pivots about a balance axis D1 which is parallel here, or substantially parallel, to axial direction D0. 'Substantially parallel' means here that axial direction D0 and the direction of balance axis D1, brought to the same point, are within a cone whose total apex angle is less than 10°.

Magnetic pivots, introduced by Montres Breguet SA in 2011, constituted a watchmaking revolution, which makes an essential contribution to chronometry.

FIG. 2 shows the typical chronometric properties of a resonator with magnetic balance pivots. The standard positions VB, VH, VD, VG, HH, HB in french, i.e. in english vertical pendant down PD, vertical pendant up PU, vertical pendant right (PR), vertical pendant left (PL), horizontal dial up DU, horizontal dial down DD, are indicated in FIG. 1, with reference to an XYZ trihedron whose Z axis corresponds to the field of gravity. This FIG. 2 shows relatively small variations in rate between the various chronometric positions, with a maximum amplitude of around 7 seconds per day, and with a small deviation during the unwinding of the barrel, on the order of 3 seconds per day (included in the aforementioned 7 seconds per day). These values represent substantial progress compared to a resonator with traditional pivots. It is seen that the largest variations in rate logically correspond to measurements made in the direction of the field of gravity, HH (english DU) and HB (english DD). The other rate values are very close to each other, and converge on a low common value, comprised between 1 second per day and two seconds per day, towards the end of unwinding of the barrel.

FIG. 3 shows the main elements of the architecture of this mechanism of adjustment member 30, with the staff 2 of balance 1 pivoted by cooperation with magnets 3 and 5 housed in solid elements 4 and 6 of structure 100. Balance 1 includes, in a conventional manner, a rim 9, carrying the micrometric adjustment members (not represented). Balance 1 includes rollers arranged to cooperate with the fork and the guard pin of a stop device 7, particularly a lever, pivotally mounted about a lever axis DA; this lever cooperates in a conventional manner with an escape wheel set 8, an escape wheel here, which is pivotally mounted about an escapement axis DE.

With regard to chronometric properties, the vertical positions can be precisely adjusted, by adjusting the unbalance of the balance, particularly via the adjustment screws on the rim. The rates in these positions are thus grouped within a relatively restricted range (±2 seconds per day, or ±1 second per day).

The horizontal dial up HH (english DU) and horizontal dial down HB (english DD) positions are practically not adjustable. Indeed, in one of these positions, the weight of the balance is added to the axial magnetic force, while in the other position, the weight is subtracted from the axial magnetic force. This results in a slight difference in rate between these two positions.

In short, the chronometric assessment is thus as follows: vertical rates curves close together, and the HH (english DU) and HB (english DD) positions further apart.

These findings are observed statistically in the chronometric readings in the course of production.

Another solution, in the tradition of Manufacture Breguet, is to use a tourbillon. This case is explained below with three main different variants according to the respective orientations of the different axes of the different wheel sets, and which are illustrated in FIGS. 4 to 13, which, in each case, are arranged in a similar manner to the first example above of a single balance on a magnetic pivot. In particular, the chronometric properties illustrated in FIG. 2 are taken and modified/adapted in the cases set out below.

Figure 5:
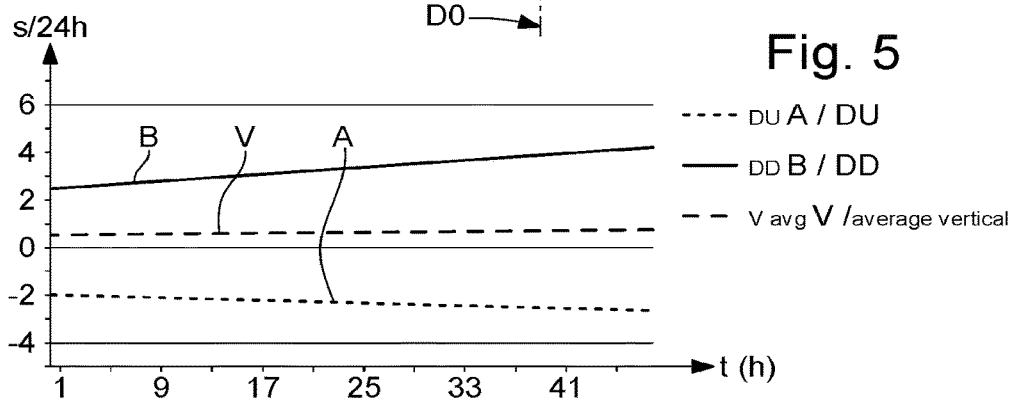
FIG. 5 is a rate diagram, similar to FIG. 2, specific to the mechanism of FIG. 4, simplified with a rate curve V which is the average of the rates measured in the vertical positions.
Figure 6:
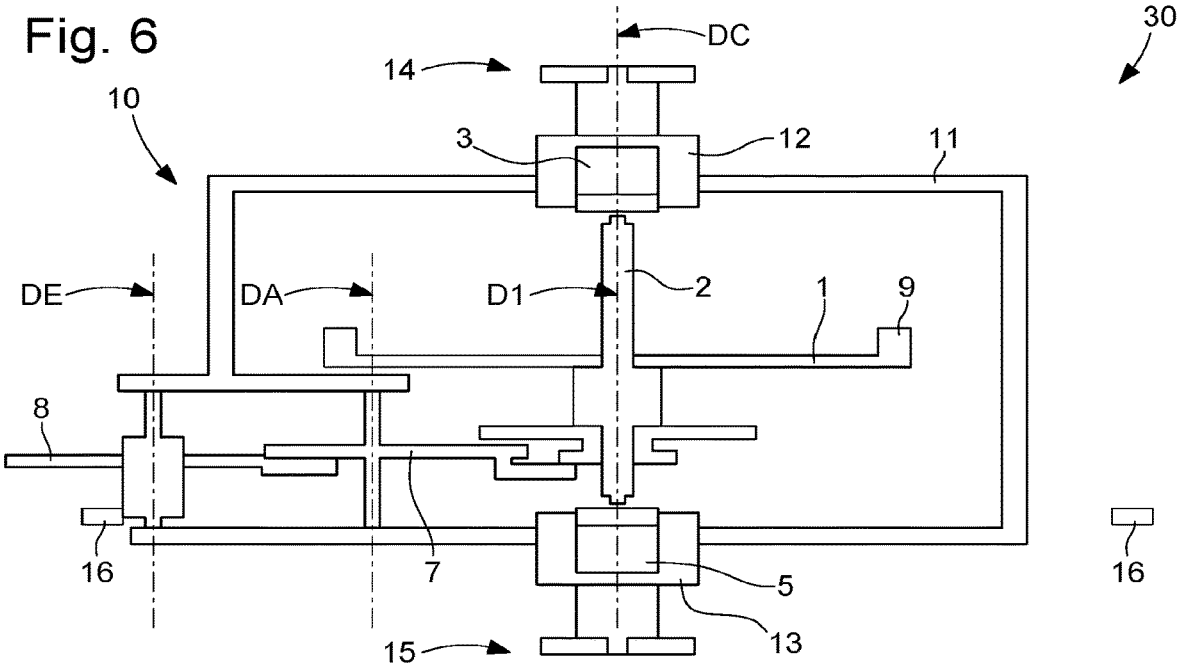
FIG. 6 represents, in a similar manner to FIG. 3, the adjustment member of the mechanism of FIGS. 4 and 5.

FIG. 5 shows the typical chronometric properties of a resonator with magnetic pivots for balance 1 placed in a tourbillon 10 in a conventional architecture, seen in FIG. 4, such that balance axis D1 is parallel to axial direction D0, to which axis DC of carriage 11 of tourbillon 10 is also parallel, as seen in FIG. 6. Staff 2 of balance 1 cooperates with magnets 3 and 5 which in this case are housed in hubs 12 and 13 of carriage 11, which hubs are pivoted in pivots 14 and 15 in structure 100. Carriage 11 carries stop device 7 and escape wheel set 8; the latter cooperates by meshing with a fixed wheel 16.

Tourbillon 10, by rotating, averages out the vertical positions.

By analysing the chronometric properties of the balance alone, according to FIG. 2, it is possible to deduce the chronometric properties of this same balance in a tourbillon whose rotation is coaxial, or parallel, to the rotation of the balance of FIG. 4. The vertical positions are averaged out, according to curve V in FIG. 5. The variation in rate between horizontal dial up HH (english DU) and horizontal dial down HB (english DD) positions remains. This conventionally mounted tourbillon 10 only slightly improves the chronometric performance of this system.

The invention therefore endeavours to develop more opportune configurations, such that the tourbillon, by rotating, averages out horizontal dial up HH (english DU) and horizontal dial down HB (english DD) positions, as well as two other vertical positions. FIGS. 7 to 13 illustrate two advantageous variants of the invention.

Figure 7:
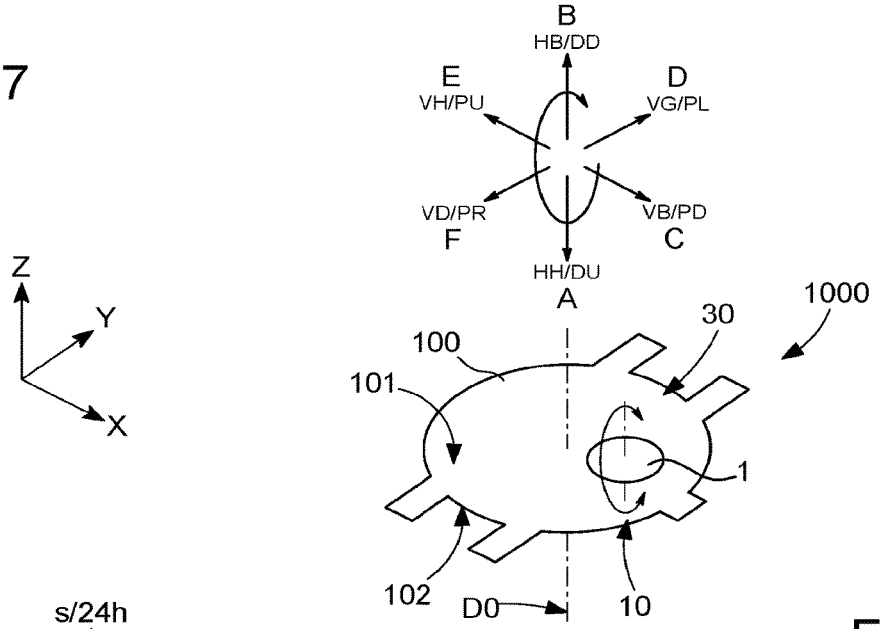
FIG. 7 represents a schematic view, similar to FIG. 1, of a mechanism comprising a first variant of the invention, with a tourbillon whose carriage axis is perpendicular to the axial direction and whose balance axis is parallel to the axial direction.
Figure 8:
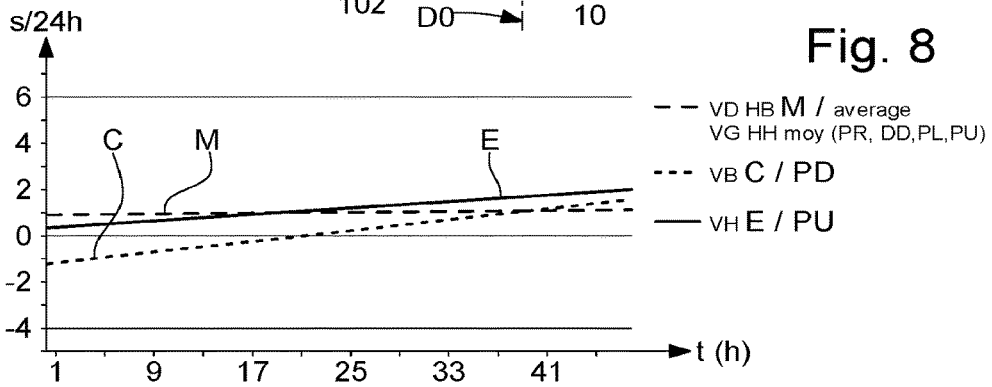
FIG. 8 is a rate diagram, similar to FIG. 2, specific to the mechanism of FIG. 7, simplified with a rate curve M which is the average of the rates measured in the vertical positions.
Figure 9:
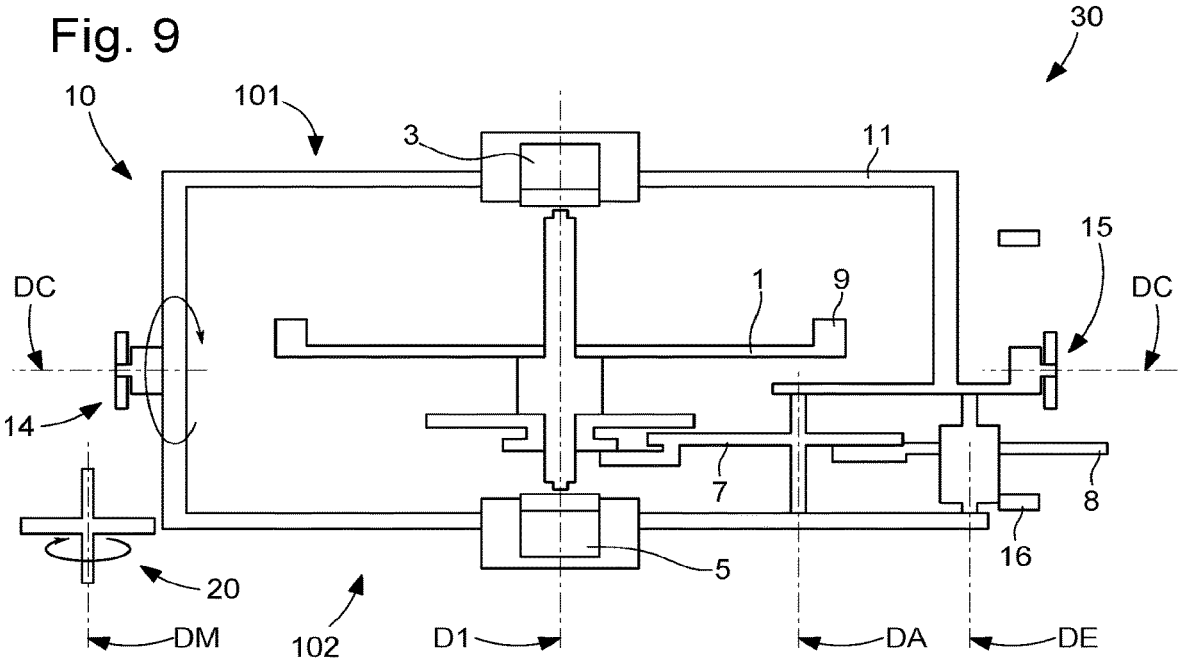
FIG. 9 represents, in a similar manner to FIG. 3, the adjustment member of the mechanism of FIGS. 7 and 8.
Figure 10:
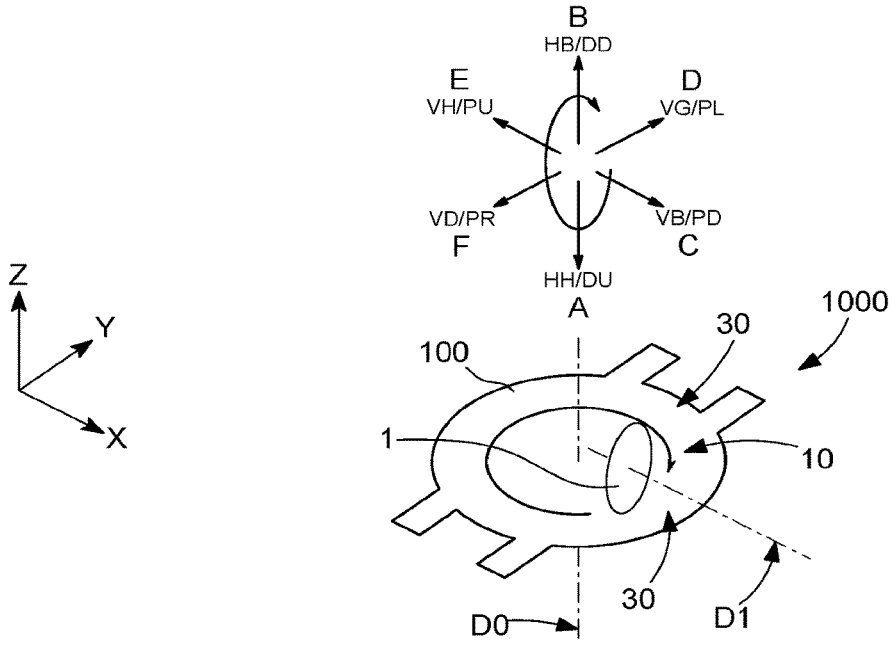
FIG. 10 represents a schematic view, similar to FIG. 1, of a mechanism comprising a second variant of the invention, with a tourbillon whose carriage axis is parallel to the axial direction and whose balance axis is perpendicular to the axial direction.

FIGS. 7 to 9 concern a first variant, including a balance 1 on magnetic pivots, with a tourbillon 10 whose carriage axis DC is substantially in the plane of watch 1000, and thus perpendicular to axial direction D0, and wherein balance axis D1 is outside the plane of the watch, in particular but not exclusively parallel to axial direction D0.

FIG. 8 shows the typical chronometric properties of a resonator with magnetic pivots for the balance placed in a tourbillon according to this modified structure, with carriage axis DC in the plane of the watch and the balance axis outside the plane of the watch. FIG. 9 shows the main elements of the architecture of this mechanism. It is seen that escape wheel set 8 meshes with a fixed wheel 16 whose orientation has changed compared to that of FIG. 6, since this fixed wheel 16 now extends into the thickness of the watch, and no longer parallel to the plate. Tourbillon 10, by rotating, averages out horizontal dial up HH (english DU) and horizontal dial down HB (english DD) positions, and two other vertical positions.

By analysing the chronometric properties of balance 1 alone, according to FIG. 2, it is also possible to deduce the chronometric properties of the same balance 1 in the tourbillon 10 of FIGS. 7 and 9. The variation values remain identical for two vertical positions VB (english CD) and VH (english CU). However, two vertical positions VD (english CR) and VG (english CL) and the two horizontal positions HH (english DU) and HB (english DD) are averaged out, according to curve M in FIG. 8. The variation in rate between HH (english DU) and HB (english DD) is eliminated by averaging out the positions covered by the tourbillon. This particular tourbillon 10 thus improves the chronometric performance of this system. The vertical space required for this device is moderate.

FIGS. 10 to 13 concern a second variant, including a balance 1 on magnetic pivots, with a tourbillon 10 whose carriage axis DC is substantially outside the plane of the watch, and balance axis D1 is in the plane of the watch.

Figure 11:
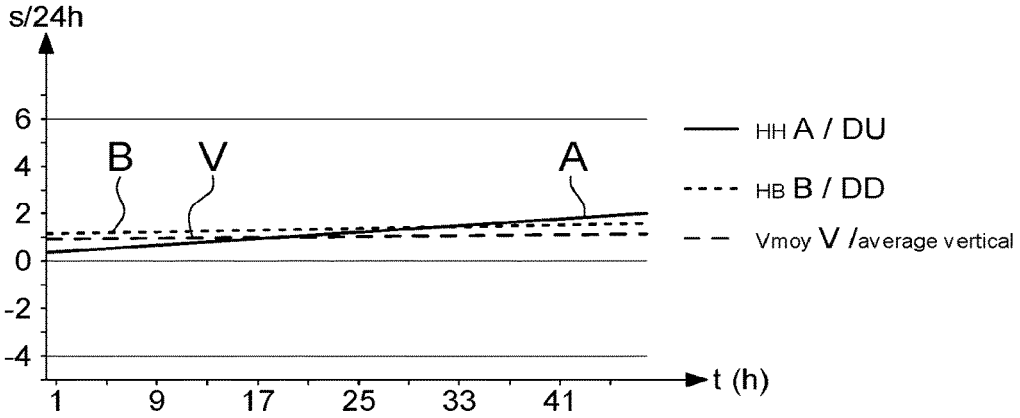
FIG. 11 is a rate diagram, similar to FIG. 2, specific to the mechanism of FIG. 10, simplified with a rate curve V which is the average of the rates measured in the vertical positions.

FIG. 11 shows the typical chronometric properties of an oscillator with magnetic pivots for the balance 1 placed in a tourbillon 10 according to this modified structure, with carriage axis DC outside the plane of the watch and balance axis D1 inside the plane of the watch. As the balance axis is no longer conventionally outside the plane of the watch, the chronometric positions are no longer equivalent to the three preceding cases.

Figure 12:
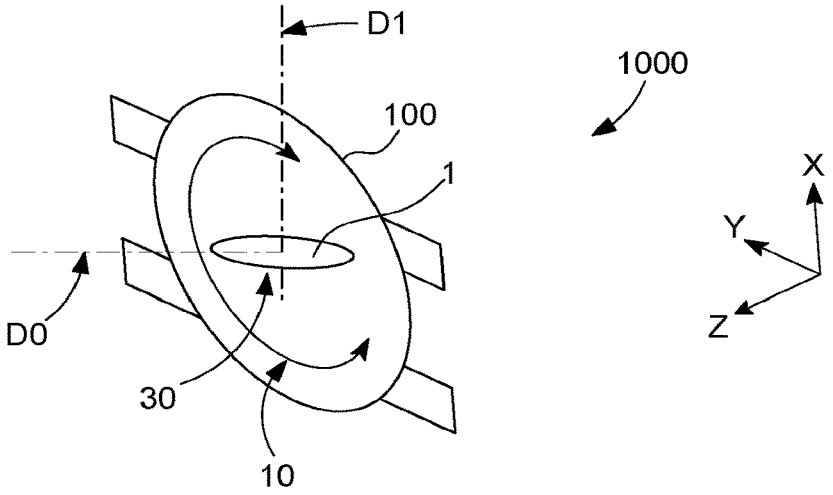
FIG. 12 is a similar view to that of FIG. 10, showing the watch in a vertical position.
Figure 13:
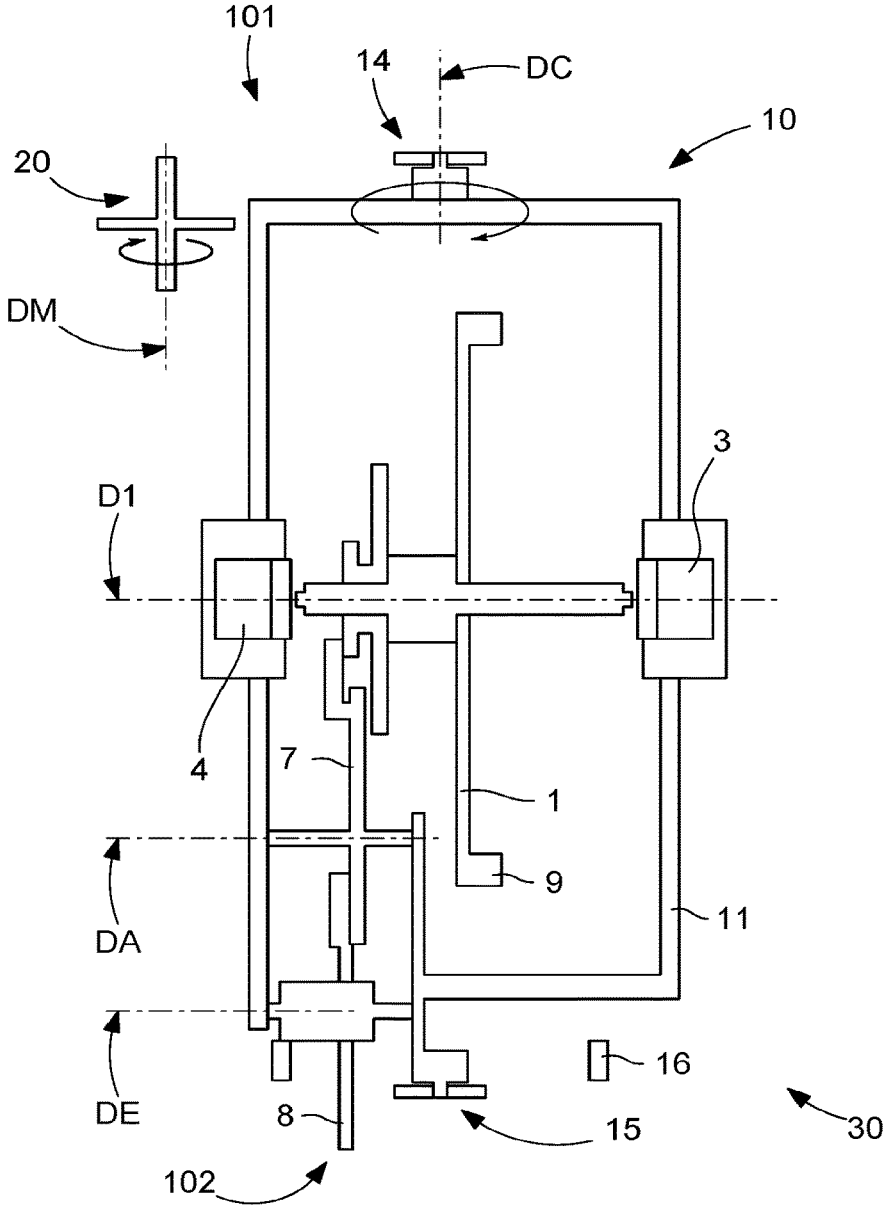
FIG. 13 represents, in a similar manner to FIG. 3, the adjustment member of the mechanism of FIGS. 10 to 12.

In this very advantageous design, positions HH (english DU) and HB (english DD) correspond to an averaging out of positions where the balance axis is horizontal. When the watch is vertical, as shown in FIG. 12, tourbillon 10 averages out positions where balance 1 is coaxial with the terrestrial field of gravity (equivalent to HH (english DU) and HB (english DD) of FIG. 2) and two positions where gravity is perpendicular to terrestrial gravity.

This tourbillon very significantly improves the chronometric performance of this system.

Depending on its size, the vertical space required may be significant, which thus restricts the use thereof to very thick watches, typically large complications. However, the amelioration of chronometric properties is such that the invention makes it possible to reduce the diameters of the balance and carriage, to restrict the overall dimensions and to render the vertical space required by such a tourbillon compatible with any high end watch.

This favourable configuration of an in-plane balance axis D1 makes it possible to consider other variants without a tourbillon, which do not form part of the invention, by inclining balance axis D1 with respect to axial direction D0.

Figure 14:
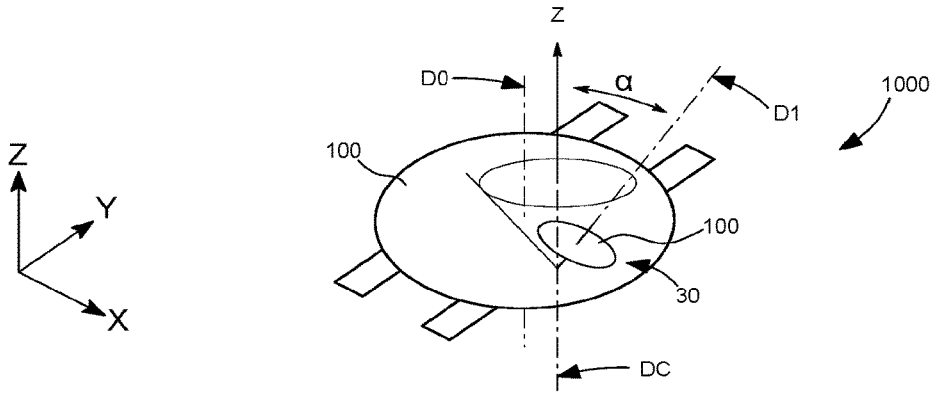
FIG. 14 represents a schematic view, similar to FIG. 1, of a similar mechanism that does not form part of the invention, with a balance whose axis is oblique with respect to the axial direction.
Figure 15:
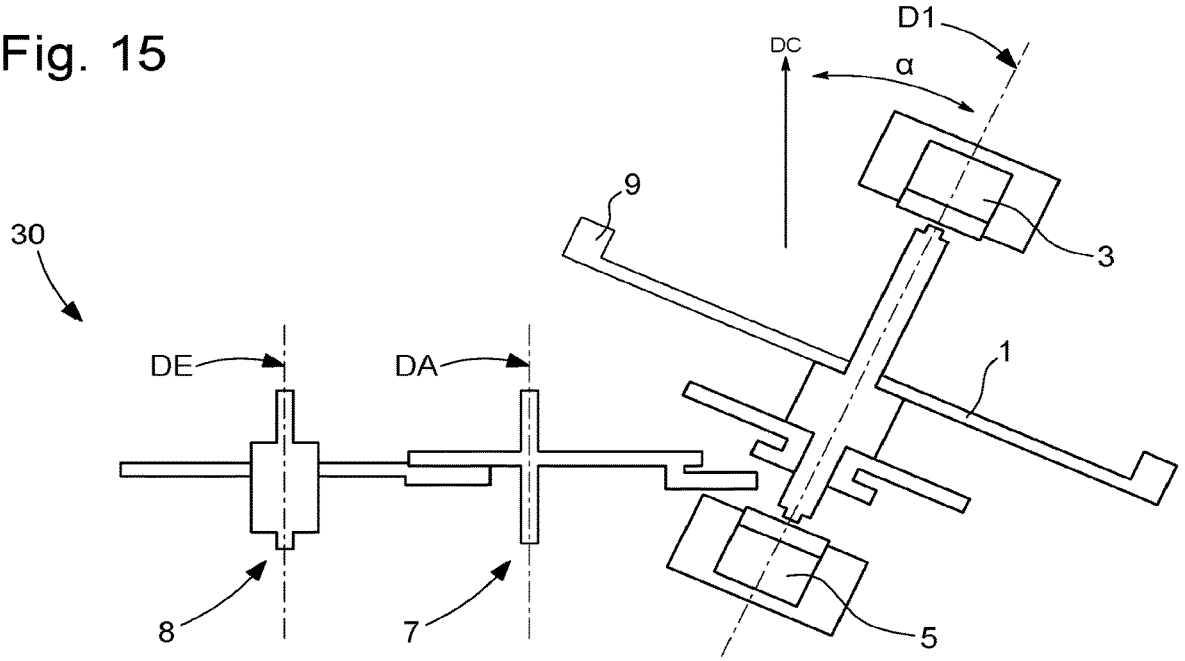
FIG. 15 represents, in a similar manner to FIG. 3, the adjustment member of the mechanism of FIG. 14.
Figure 16:
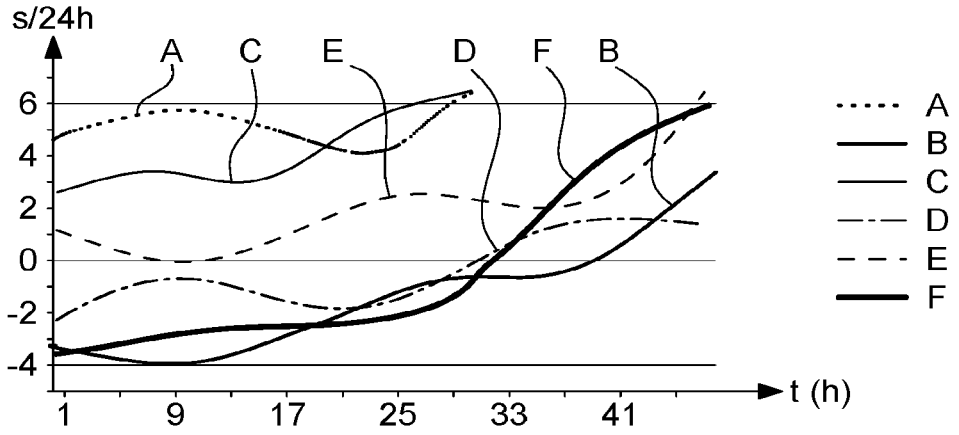
FIG. 16 is a rate diagram, similar to that of FIG. 2, in the case of a conventional watch with an adjustment member that has mechanical pivots.
Figure 17:
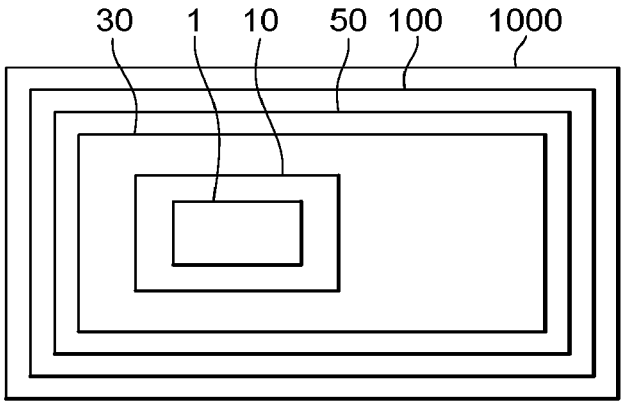
FIG. 17 is a block diagram representing a watch including such an adjustment member.

FIGS. 14 and 15 illustrate such a mechanism without a tourbillon, wherein balance 1 is simply inclined at an angle $\alpha$. Indeed, a simple solution to the problem relating to positions HH (english DU) and HB (english DD) is to artificially remove these positions by tilting the balance, for example at an angle comprised between 20° and 70°, more particularly between 30° and 60°, more still particularly between 40° and 50°. However, in this very economical solution there remains a position of the watch in which the balance is coaxial with gravity.

FIG. 15 constitutes a particular example of geometry.

It is understood that the escapement line may have one or more perpendicular or oblique deviating wheels. This also makes the entire mechanism very compact.

Different deviating configurations, at 90° or at any angle, can be used:

between the lever and the balance roller;

and/or between the lever and the escape wheel;

and/or between the escape wheel and the fixed fourth wheel.

Thus, the invention concerns an adjustment member 30 for a watch 1000 comprising a fixed structure 100 extending substantially perpendicularly to an axial direction D0. This adjustment member 30 comprises a regulating member with a balance 1 arranged to pivot about a balance axis D1.

According to the invention, this balance 1 is pivoted by magnetic pivots in a carriage 11, arranged to pivot about a carriage axis DC, and comprised in a device 10 for annulling variations in rate in the vertical positions, formed by a tourbillon or a carrousel, comprised in adjustment member 30. and carriage 11 carrying magnets 3, 5 defining balance axis D1 which is perpendicular or oblique to carriage axis DC.

In the first variant of FIGS. 7 to 9, balance 1 is pivoted by such magnetic pivots in such a carriage 11, whose carriage axis DC is perpendicular or substantially perpendicular to axial direction D0. More particularly, this carriage axis DC is perpendicular to axial direction D0.

In the second variant of FIGS. 10 to 13, balance 1 is pivoted by such magnetic pivots in a carriage 11, whose carriage axis DC is parallel or substantially parallel to axial direction D0. More particularly, this carriage axis DC is parallel to axial direction D0.

More particularly, in the first or second variant, carriage axis DC is perpendicular or oblique to balance axis D1.

More particularly still, in the first or second variant, carriage axis DC is perpendicular to balance axis D1.

More particularly, in the first or second variant, balance 1 is arranged to cooperate indirectly, via a stop device 7, with an escape wheel set 8 which meshes with a fixed wheel 16.

More particularly, in the first variant, the axis of fixed wheel 16 is perpendicular to axial direction D0.

More particularly, in the second variant, the axis of fixed wheel 16 is parallel to axial direction D0.

In the variant of FIGS. 14 and 15, which do not form part of the invention, balance 1 is pivoted by magnetic pivots directly in fixed structure 100 which carries magnets 3, 5 arranged to give balance axis D1 an oblique direction with respect to axial direction D0, but not perpendicular to axial direction D0. More particularly, balance 1 is arranged to cooperate indirectly, via a stop device 7, with an escape wheel set 8 which is arranged to be driven, directly or via a gear train, by energy storage means. More particularly, as seen in FIG. 15, balance 1 is arranged to cooperate obliquely with stop device 7.

The invention also concerns a watch 1000 comprising a fixed structure 100 extending substantially perpendicularly to an axial direction D0, and an adjustment member 30, and including energy storage means arranged to drive carriage 11 directly or via a train.

The invention also concerns a method for optimising the chronometric properties of a mechanical watch 1000 comprising a fixed structure 100 extending substantially perpendicularly to an axial direction D0, and comprising an adjustment member 30 comprising a regulating member with a balance 1 arranged to pivot about a balance axis D1, according to which method:

- target rate values are defined in at least each of the six standard timing positions;
- the chronometric properties of watch 1000 are measured at least in the six standard positions;
- adjustment member 30 is modified to give balance axis D1 an oblique or perpendicular orientation with respect to axial direction D0,
- another measurement is made of the chronometric properties of watch 1000 at least in the six standard positions, and the measured rate values are compared to the target values;
- modification of adjustment member 30 ceases as soon as the measured rate values are less than the target values.

More particularly, when, after the new measurement, the measured rate values are greater than the target values, adjustment member 30 is modified again, by replacing the pivots of balance 1 with magnetic pivots, and by placing balance 1 inside a carriage 11 arranged to pivot about a carriage axis DC, and comprised in a device 10 for annulling variations in rate in the vertical positions, formed by a tourbillon or carrousel, which is incorporated in adjustment member 30.

More particularly still, carriage 11 is provided with magnets 3, 5 forming magnetic pivots and defining balance axis D1 perpendicular or oblique to carriage axis DC.

It should be noted that, although tilting balance axis D1 with respect to axial direction D0 is advantageous for improving the chronometric properties of a watch, the best result is achieved with magnetic pivots, whose rate diagrams show much better grouping in the vertical positions than with conventional pivots, a much smaller variation (wavy rate curves) during the power reserve time than with conventional pivots, and a small deviation during the power reserve time whereas, with the use of conventional pivots, rates deviate substantially after 24 hours. Comparing FIGS. 2, 5, 8, 11 and 16 clearly shows these advantages.

To simplify, the main effect of the magnetic pivots is to group together the rate curves in the vertical positions, with substantially linear rate curves and with a small deviation, and, when this arrangement is combined with an oblique orientation of the balance axis, the rate curves in all positions are both substantially closer to each other, and linear in shape, and curves corresponding to the vertical positions are virtually coincident.

In short, in the very advantageous case of the use of a tourbillon with a novel arrangement of the axes of the wheel sets, combined with the use of magnetic bearings, the rotation of the carriage at least partially averages out the positions where terrestrial gravity is coaxial with the (magnetic) balance axis.

The chronometric performance of the adjustment member is better in all positions of the watch.

The invention claimed is:

1. An adjustment member for a watch comprising a fixed structure extending substantially perpendicularly to an axial direction, said adjustment member comprising:

- a regulating member with a balance arranged to pivot about a balance axis, wherein said balance is pivoted by magnetic pivots positioned in hubs of a carriage, arranged to pivot about a carriage axis, and comprised in a device for annulling variations of rate in the vertical positions, formed by a tourbillon or a carrousel, comprised in said adjustment member, said carriage being an outer most carriage of the tourbillon or the carrousel and configured to be directly attached to the fixed structure, and said carriage carrying magnets defining said balance axis, said balance axis being perpendicular with respect to said carriage axis,
- wherein said balance is pivoted by said magnetic pivots in said carriage, whose carriage axis is parallel or substantially parallel to said axial direction.

2. The adjustment member according to claim 1, wherein said carriage axis is parallel to said axial direction.

3. The adjustment member according to claim 1, wherein said balance is arranged to cooperate indirectly, via a stop device, with an escape wheel set that meshes with a fixed wheel.

4. The adjustment member according to claim 1, wherein said balance is arranged to cooperate indirectly, via a stop device, with an escape wheel set that meshes with a fixed wheel, and wherein the axis of said fixed wheel is parallel to said axial direction.

5. A watch comprising:

- the fixed structure extending substantially perpendicularly to the axial direction, and
- the adjustment member according to claim 1, and including energy storage means arranged to drive said carriage directly or via a train,
- wherein said carriage is directly attached to the fixed structure.

6. A method for optimising chronometric properties of a mechanical watch comprising a fixed structure extending substantially perpendicularly to an axial direction, and comprising an adjustment member comprising a regulating member with a balance arranged to pivot about a balance axis, the method comprising:

- defining target rate values in at least each of six standard timing positions, the six standard timing positions including vertical pendant down, vertical pendant up, vertical pendant right, vertical pendant left, horizontal dial up, and horizontal dial down;

measuring the chronometric properties of said watch at least in the six standard positions;

modifying said adjustment member to give said balance axis an oblique or perpendicular orientation with respect to said axial direction;

measuring again the chronometric properties of said watch at least in the six standard positions, and the measured rate values are compared to said target values; and ceasing the modifying said adjustment member as soon as the measured rate values are less than said target values, wherein, when, after said measuring again, said measured rate values are greater than said target values, said adjustment member is modified again, by replacing the pivots of said balance with magnetic pivots, and by placing said balance inside a carriage arranged to pivot about a carriage axis, and comprised in a device for annulling variations of rate in the vertical positions, formed by a tourbillon or carrousel, which is incorporated in said adjustment member, said carriage being an outer most carriage of the tourbillon or the carrousel and configured to be directly attached to the fixed structure, and said carriage including hubs that carry magnets defining said balance axis, said balance axis being perpendicular or oblique with respect to said carriage axis, wherein said balance is pivoted by said magnetic pivots in said carriage, whose carriage axis is parallel or substantially parallel to said axial direction.

7. The method according to claim 6, wherein said carriage is provided with magnets forming magnetic pivots and defining said perpendicular or oblique balance axis to said carriage axis.

* * * * *